US008047880B2

(12) United States Patent
Fields et al.

(10) Patent No.: US 8,047,880 B2
(45) Date of Patent: Nov. 1, 2011

(54) MINI DISPLAYPORT

(75) Inventors: Stewart Shannon Fields, Bend, OR (US); Matthew K. Herndon, San Carlos, CA (US); Min Chul Kim, Santa Clara, CA (US); Ron Larson, Mountain View, CA (US); Richard J. Middlehurst, Fremont, CA (US); Anilkumar R. Pannikkat, Mountain View, CA (US); Glenn Wheelock, San Jose, CA (US); Colin Whitby-Strevens, Ben Lomond, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/910,722

(22) Filed: Oct. 22, 2010

(65) Prior Publication Data

US 2011/0039443 A1 Feb. 17, 2011

Related U.S. Application Data

(63) Continuation of application No. 12/239,099, filed on Sep. 26, 2008, now Pat. No. 7,841,910.

(60) Provisional application No. 61/028,503, filed on Feb. 13, 2008, provisional application No. 61/002,143, filed on Nov. 6, 2007.

(51) Int. Cl.
*H01R 13/64* (2006.01)

(52) U.S. Cl. ..... 439/680; 439/357

(58) Field of Classification Search ..... 439/357, 439/358, 677, 680
See application file for complete search history.

(56) References Cited

U.S. PATENT DOCUMENTS

| | | | | |
|---|---|---|---|---|
| 6,174,943 | B1 * | 1/2001 | Matsumoto et al. | 524/115 |
| 7,252,549 | B2 * | 8/2007 | Nishio et al. | 439/607.55 |
| 7,318,752 | B2 * | 1/2008 | Fujimoto et al. | 439/660 |
| 7,467,977 | B1 | 12/2008 | Yi et al. | |
| 2005/0124219 | A1 | 6/2005 | Chen et al. | |
| 2005/0202727 | A1 | 9/2005 | Andre et al. | |
| 2006/0094301 | A1 | 5/2006 | Lee et al. | |
| 2007/0049119 | A1 | 3/2007 | Fujimoto et al. | |
| 2009/0117754 | A1 | 5/2009 | Fields et al. | |
| 2009/0176413 | A1 | 7/2009 | Degner et al. | |
| 2009/0186527 | A1 | 7/2009 | Hardell et al. | |

* cited by examiner

*Primary Examiner* — James Harvey
(74) *Attorney, Agent, or Firm* — Kilpatrick Townsend & Stockton LLP

(57) ABSTRACT

Connectors having a smaller profile. These connectors are useful as a reduced form factor DisplayPort connector. Keys on a receptacle are used to indicate when an insert is fully engaged. Edges of the receptacle and insert are chamfered in such a way as to prevent the pins of the connector from being damaged when an improper insertion is attempted. User experience is also enhanced by the use of one or more latches. As the connector is inserted, the latch provides resistance that builds until the connector is inserted a certain distance, after which the latch enters a cutout portion of the insert thus releasing the pressure and letting the user know the connection has been made. Fingers are employed to provide mechanical stability and electrical connection between receptacle and insert.

19 Claims, 8 Drawing Sheets

1. Pins may be on one or both sides.

2. Pins on a side may have the same or different sizes and spaces to adjacent pins.

3. Pins on a side may have the same or different sizes and spacing as compared to other side.

MINI DISPLAYPORT

CROSS-REFERENCES TO RELATED APPLICATIONS

This application is a continuation of U.S. patent application Ser. No. 12/239,099, filed Sep. 26, 2008, titled "Mini DisplayPort," which claims the benefit of U.S. provisional application No. 61/028,503, filed Feb. 13, 2008, titled "Mini DisplayPort," and U.S. provisional application No. 61/002,143, filed Nov. 6, 2007, titled "Mini DisplayPort," all of which are incorporated by reference.

BACKGROUND

Many electronic devices connect to each other using cables typically made up of a number of wires connected to pins located in connectors at each end of the cable. These connectors then mate with connectors in the electronic devices. These connectors may be based on a standard, that is, the connector may have an agreed-to size and pin location, or they may be proprietary.

Other connectors may be a hybrid of these, that is, the pin functions may be standardized, but the pin locations and connector form factor may be proprietary. Such a connector may be used on one end of a cable while a standard connector is used on the other. This arrangement has the advantage of allowing devices to use a proprietary connector to connect to a standardized device.

In some applications it is desirable to reduce the size of these connectors. For example, a low height, or smaller z direction, allows a connector to be used on a thinner device. A narrower connector, a shorter x direction, allows more connectors to be included along an edge or side of a device.

Unfortunately, smaller connectors require pin spacing to be reduced. Reduced spacing results in a higher level of signal crosstalk and interaction. This in turn diminishes signal integrity and hampers device performance.

Smaller connectors may also create an undesirable user experience. That is, it may be hard for users to know when they have properly inserted the cable connector into the device connector. It may be hard for uses to know if they have inserted the connector in the correct direction and whether they have fully inserted the connector.

Thus, what is needed are connectors having a reduced size, a high level of signal integrity, and provide a tactile feedback to users such that they can determine whether a connection has been properly made.

SUMMARY

Accordingly, embodiments of the present invention provide small form factor connector system for multi-lane high-speed digital interfaces. The profile, or form factor, of the connectors may be smaller in either or both height, or z direction, and width, or x direction. While these connectors are particularly useful as a smaller DisplayPort connector, referred to herein as a Mini DisplayPort connector, the concepts described herein may be used with other types of connectors. These connectors are useful as a reduced form factor DisplayPort connector, though embodiments may be used as connectors for other interfaces presently available, and it is expected that they will be useful for interfaces developed in the future.

An exemplary embodiment of the present invention provides a connector receptacle that includes keys to indicate when a connector insert is fully engaged. Edges of the receptacle are chamfered such that a connector insert cannot be inserted upside down. This helps to prevent the pins of the connector and associated circuitry from being damaged when an improper insertion is attempted. User experience is also enhanced by the use of one or more latches. As the connector is inserted, the latch provides resistance that builds until the connector is inserted a certain distance, after which the latch enters a cutout portion of the insert thus releasing the pressure and letting the user know the connection has been made. Fingers are employed to provide mechanical stability and electrical connection between connector receptacle and connector insert.

Another exemplary embodiment of the present invention provides connector insert to be inserted into a connector receptacle. The connector insert includes one or more cutout portions to receive the one or more latches on the connector receptacle when the connector insert is fully inserted into the connector receptacle. The frame of the connector insert has chamfered corners such that upside-down insertion into the connector receptacle is prevented.

Embodiments of the present invention provide a connector design that allows peripheral devices to be connected to computers using high speed multi-lane digital signaling. The initial application is DisplayPort, which currently requires 1, 2 or 4 lanes of high speed video signaling at speeds of 1.62 Gbps or 2.7 Gbps per lane using differential signaling, with future anticipated speeds of 5.4 Gbps, high speed auxiliary channel signaling at 1 Mbps using differential signaling, with future anticipated speeds of approximately 600 Mbps, two configuration connections, a peripheral presence connection ("Hot Plug Detect"), and power/ground connections supporting up to 3.6V and 0.5 A. DisplayPort provides a total of 20 contacts, including a number of grounds for ensuring signal integrity. A specific embodiment of the present invention provides connectors capable of supporting speeds on the high speed lanes in excess of 7 Gbps per lane, and 2 Gbps on the auxiliary channel. In a specific embodiment of the present invention, the connector height (including overmold) is less than 8 mm, while the connector width permits four connectors to be deployed on a "Reduced height" Peripheral Component Interconnect (PCI) or Peripheral Component Interconnect Express (PCIe) card. It is further desirable that the overmold be of constant thickness relative to the connector tongue.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
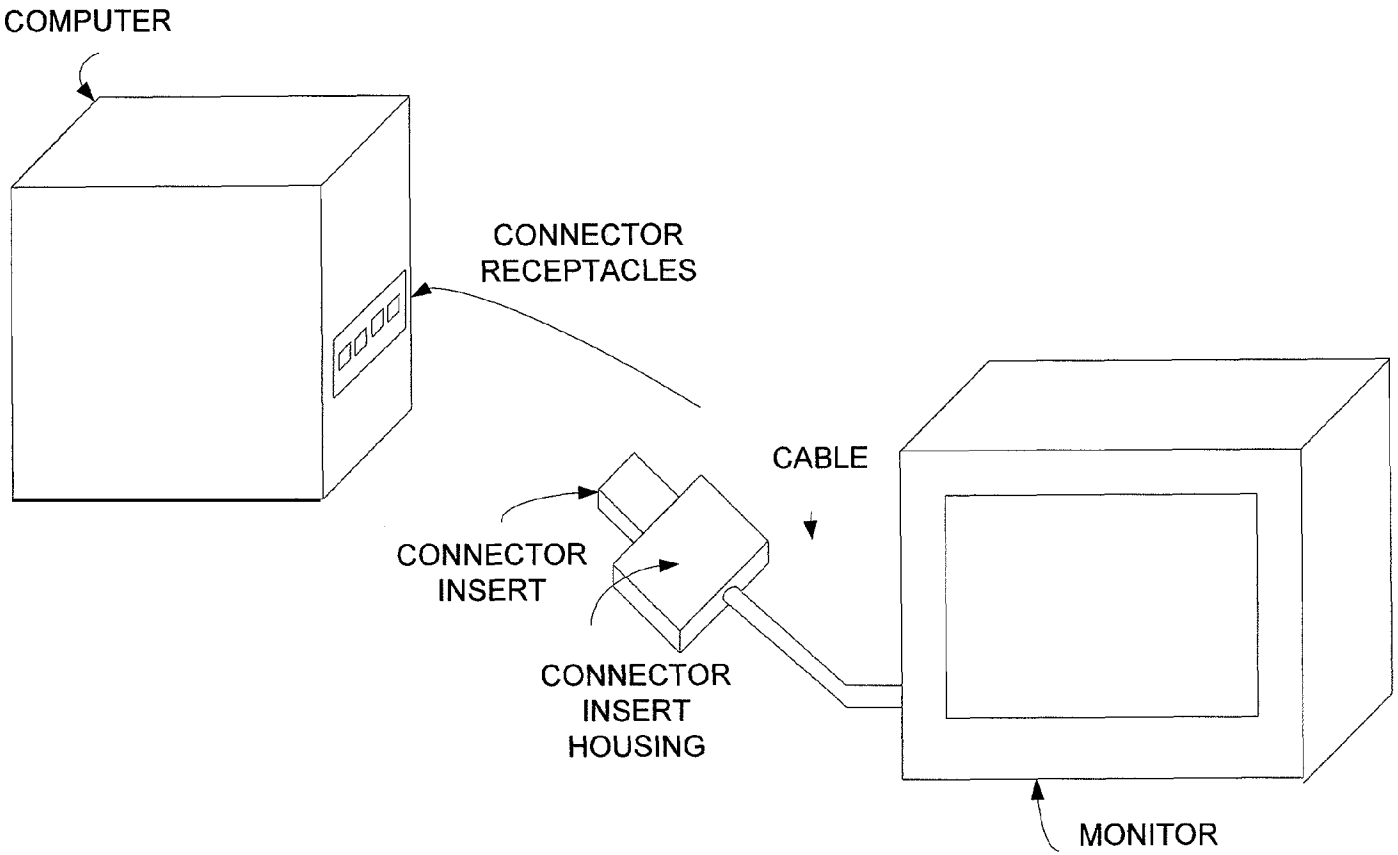
FIG. 1 illustrates an electronic system utilizing a connector including a connector receptacle and connector insert according to an embodiment of the present invention.

FIG. 1 illustrates an electronic system utilizing a connector including a connector receptacle and connector insert according to an embodiment of the present invention. This figure includes a computer that has a number of proprietary Mini DisplayPort connectors that are capable of driving monitors, only one of which is shown here for simplicity. The Mini DisplayPort connectors may be located on a PCIe card. This figure, as with the other included figures, is shown for illustrative purposes only and do not limit either the possible embodiments of the present invention or the claims.

In this example, the computer includes four connector receptacles according to an embodiment of the present invention, though other computers may include one or more such connectors. One or more of these connector receptacles may be located on other types of electronic devices, for example, portable media devices, cameras, set-top boxes, computers, and others. The use of a connector receptacle having a shorter width allows four connectors to be included on one card, which again may be a PCIe card. When the connector receptacle is thinner, it may be used on devices such as thin laptops.

A cable connects to the connector receptacle using a connector insert. A connector insert housing is provided to allow electrical connections to be made between wires in the cable and pins located in the connector insert. The connector housing also provides something for a user to hold while inserting the connector insert into the connector receptacle.

The other end of the cable may be a standard or proprietary connection. For example, where the connector receptacle provides pins for a mini DisplayPort, the second end of the cable may be a standard DisplayPort or DVI connector. This connector may be used to make a connection to the monitor.

While embodiments for of the present invention are particularly well suited to provide a reduced size DisplayPort connector receptacle and connector insert, other embodiments of the present invention may be employed for other types of connections. Also, in the future, other types of interfaces will be developed, and these connector receptacles and connector inserts will be useful for those as well.

Figure 2:
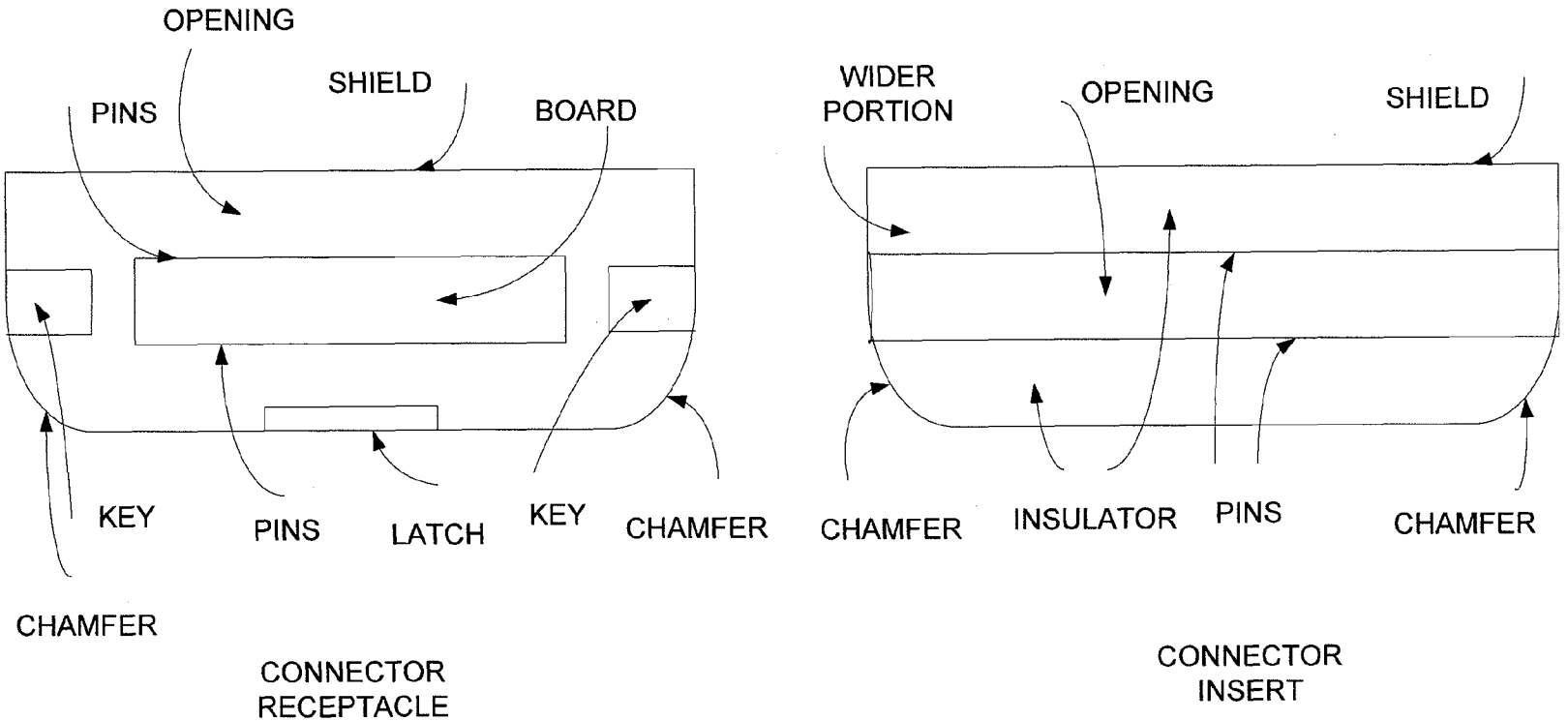
FIG. 2 illustrates front view of a connector receptacle and connector insert according to an embodiment of the present invention.

FIG. 2 illustrates front views of a connector receptacle and connector insert according to an embodiment of the present invention. When used as a DisplayPort connector, the profiles of the connector insert and connector receptacle are shorter, or narrower, or both shorter and narrower than a standard DisplayPort connector.

The connector receptacle comprises an opening that is bounded by a frame or shield. The shield may be made of metal or other conductive or nonconductive material. The opening includes a board. This board may be a board made of plastic or other insulating or other type of material. In a specific embodiment, the plastic is free or substantially free of bromine and chlorine. The board may have a number of pins on one or both sides. The board may also have pins on the ends, though such pins are not shown in this example. The pins may be metal, and they may have an amount of bias or spring associated with them to ensure proper contact with pins in the connector insert.

The connector receptacle in this example includes two keys, though in other embodiments of the present invention, other numbers of keys may be used. These keys act to stop further insertion of a connector insert into the connector receptacle once insertion is complete. These keys may be made of metal, for example, they may be stamped or otherwise formed as part of the connector receptacle frame, or they may be made of other materials.

The connector insert may be solid having an opening in which the board on the connector receptacle is inserted during use. Alternately, it may have two solid portions, one on either side of the opening. The opening may have pins on its top and bottom. Also, the opening may have pins on the sides, though such pins are not shown in this example. The pins may be metal or other conductive material, and they may have an amount of bias or spring associated with them to ensure proper contact with pins in the connector receptacle. The connector insert may be enclosed in a sheath that is made of metal or other material. The sheath may at least partially surround an insulating material such as plastic, such that the pins do not electrically short to the sheath. This plastic may again be free or substantially free of bromine and chlorine.

The connector receptacle is chamfered on both sides of its bottom. When the connector insert is properly inserted into the connector receptacle, the chamfered portion of the connector insert fits with the chamfered portion of the connector receptacle portion. When the connector insert is improperly inserted, that is, it is inserted upside down, the wider portion of the connector insert is blocked by the chamfered portion of the connector receptacle, thereby preventing improper insertion and possible resulting damage to the connector or connected electronic devices. This arrangement is also at variance with other common connectors now in use. This prevents accidental insertion of connectors designed for other standard interfaces, thereby preventing damage to the connectors and associated electronic devices.

As the connector insert is inserted into the connector receptacle, a latch portion of the connector receptacle provides a level of resistance to the user. As the connector is inserted past a point, the latch releases this resistance, thereby indicating to the user that the connector insert is properly seated in the connector receptacle. The latch portion of the connector receptacle fits with a cutout portion of the connector insert (not shown) thereby preventing accidental removal of the connector insert. While one latch is shown in this example, other embodiments of the present invention may employ other numbers of latches along with one or more or a corresponding number of insert cutouts. Moreover, while these examples show latches on connector receptacles, in other embodiments of the present invention, latches are located on the connector insert. Latches and cutouts are explained further in the following figures.

Figure 3:
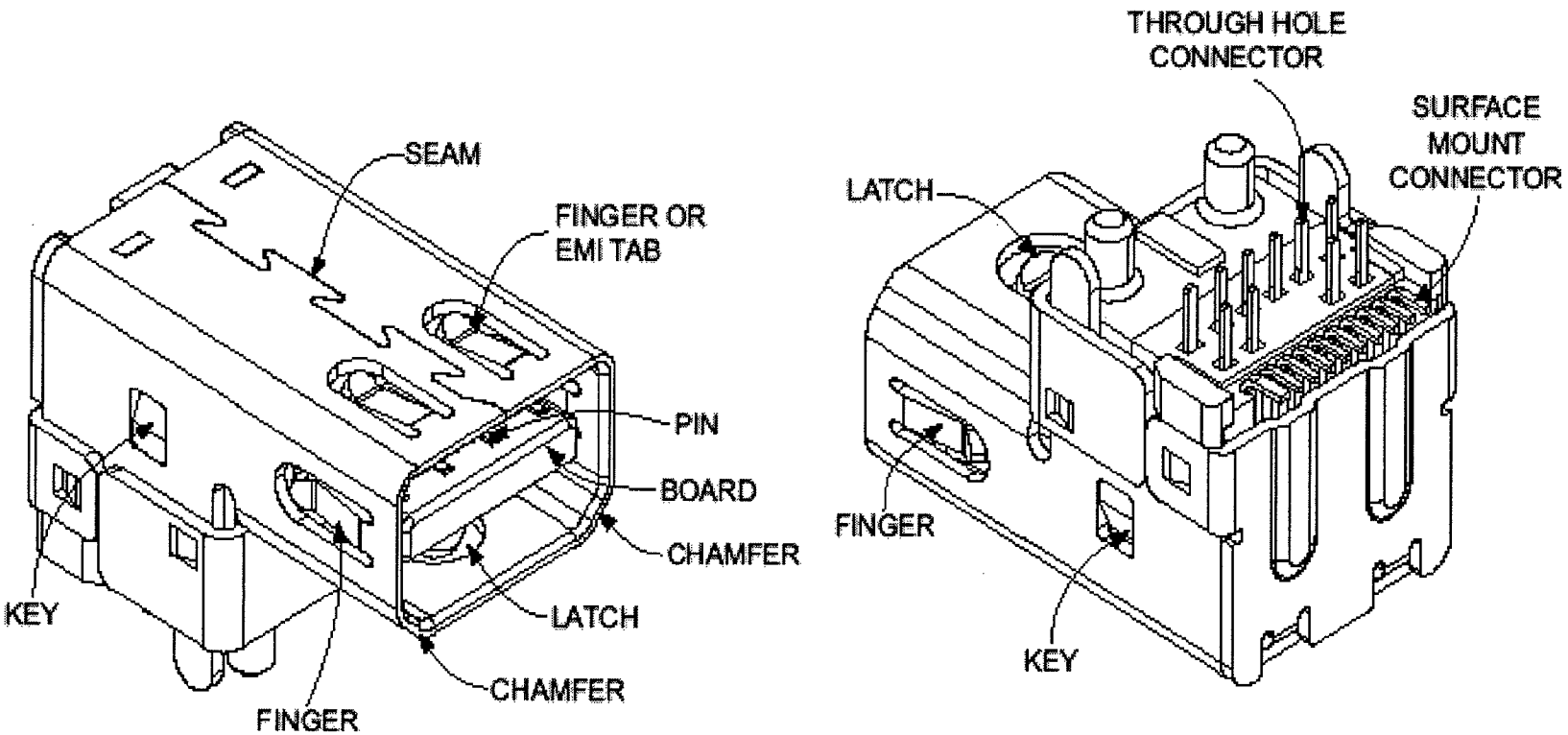
FIG. 3 illustrates a connector receptacle according to an embodiment of the present invention.

FIG. 3 illustrates a connector receptacle according to an embodiment of the present invention. In this example, two keys are shown, one on each side of the connector receptacle opening. These keys may be formed by stamping. Alternately, these keys may be formed using another appropriate method. While in this example, the keys are shown in as rectangular in nature, in practical receptacles, connectors may be curved, triangular in nature, or they may have other shapes.

Specifically, the shape of the key as viewed from the front of the connector receptacle may be rectangular, curved, or it may have other shapes. Further, viewed from the side of the connector receptacle, the key may also be rectangular, curved, or may have other shapes. The key is recessed from the front of the opening of the connector receptacle an amount that indicates when the connector insert is fully inserted.

The connector receptacle opening is chamfered. In this example, it is symmetrically chamfered for esthetic reasons, though in other embodiments the chamfering may be asymmetrical. For example, only one side or three sides may be chamfered. It is desirable that when a connector insert is inserted backwards, or upside down, that the chamfered portions give the user a clear indication that the connector insert is being incorrectly inserted. That is, the chamfers should provide a non-reversible connection rejection feature. It is also desirable that the chamfers block insertion in such a way as to prevent damage to the connector receptacle board and related circuitry. In a specific embodiment, the chamfers prevent an incorrectly inserted connector insert from breaking the face plane of the connector receptacle.

The connector receptacle of this example also includes a number of fingers or Electromagnetic Interference (EMI) tabs. In this example, five fingers, one of which is referred to as a latch are included. Specifically, two fingers are located on the top of the connector receptacle, one finger is included on each side, while the latch is located on the bottom. These fingers provide mechanical stability and electrical contact between the shields of the connector receptacle and connector insert.

The connector connects to circuitry internal to an electronic device using a number of through-hole and surface-mount pins. In this example, two rows of through holes and one of surface mounts are used. The through holes provide mechanical stability, and this arrangement allows inspection and rework to be performed when necessary during assembly since there are no hidden or inaccessible surface-mount pins.

Figure 4:
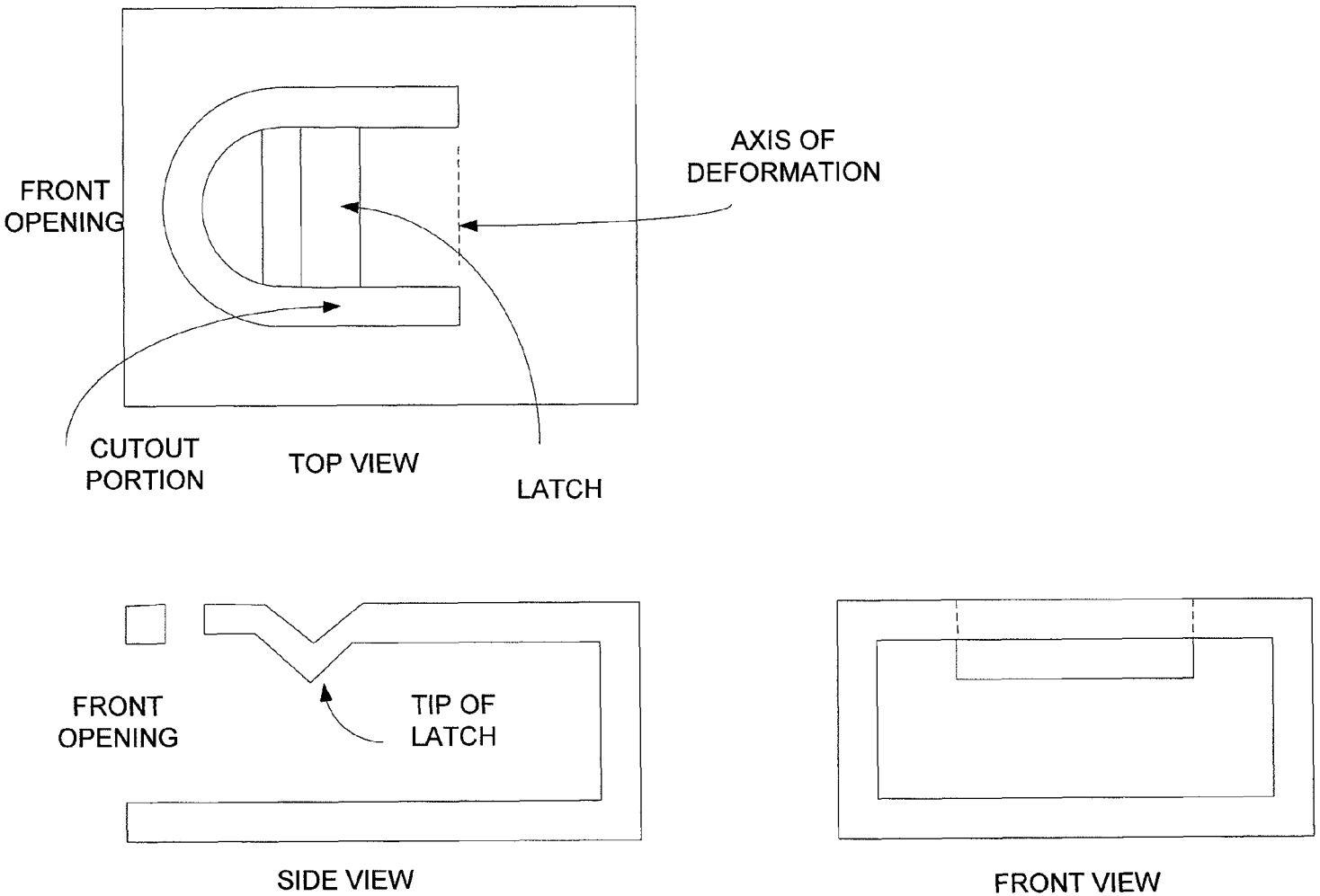
FIG. 4 illustrates top, side, and front views of a latch on a connector receptacle according to an embodiment of the present invention.

FIG. 4 illustrates top, side, and front views of a latch located on a connector receptacle according to an embodiment of the present invention. As can be seen from the top view, the latch can be formed by removing a cutout portion on one side of the connector receptacle. In a specific embodiment of the present invention, the cutout portion is removed on the bottom of the connector receptacle, though in other embodiments of the present invention, it may be located on another side of the connector receptacle. As shown in this example, the latch includes an indented portion that is bent into the cavity formed by the connector receptacle inner wall, though in other embodiments, other shapes may be used.

As the connector insert is inserted into the front opening of the connector receptacle, the latch provides an initial resistance to the user. As the user pushes the connector insert into the connector receptacle, the latch deforms roughly along the axis of deformation as shown. When the connector insert reaches the tip of the latch, the latch stops providing resistance and the insert can continue to be pushed in. As the latch is pushed in, a cutout portion of the connector insert reaches the latch, and tension on the latch is released as the tip of the latch enters the cutout portion of the connector insert. This provides tactile feedback to the user that the connection has been made and improves the user experience. In a specific embodiment of the present invention, the tactile experience is akin to that of a snap, letting the user know that a connection has been achieved. That is, the latch provides cognitive feedback that a connection has been made. In other embodiments, the resistance provided by the latch is negligible or nonexistent. When the tip of the latch is in the cutout on the connector insert, the latch provides resistance that helps to prevent accidental removal of the connector insert. This resistance may be adjusted by controlling the displacement of the latch tip compared to the remainder of the receptacle housing, by adjusting the size of the latch, the depth of the cutout portion of the connector insert, thickness of the latch material, and other factors.

Once the connector insert has been correctly inserted into the connector receptacle, it is desirable that this connection has a high degree of mechanical stability. Accordingly, embodiments of the present invention employ additional fingers to provide this stability. As discussed above, in a specific embodiment, four additional fingers are used, though in other embodiments of the present invention, other numbers of fingers may be used. Two of these fingers are on the top of the connector receptacle and two of these fingers are on the bottom. The fingers are all oriented in a direction opposite the latch shown in FIG. 4. Specifically, these fingers point towards the back of the receptacle, away from the receptacle opening. When inserted, these fingers apply an amount of pressure to the top and bottom of the connector insert thus providing the desired stability and electrical contact.

Figure 5:
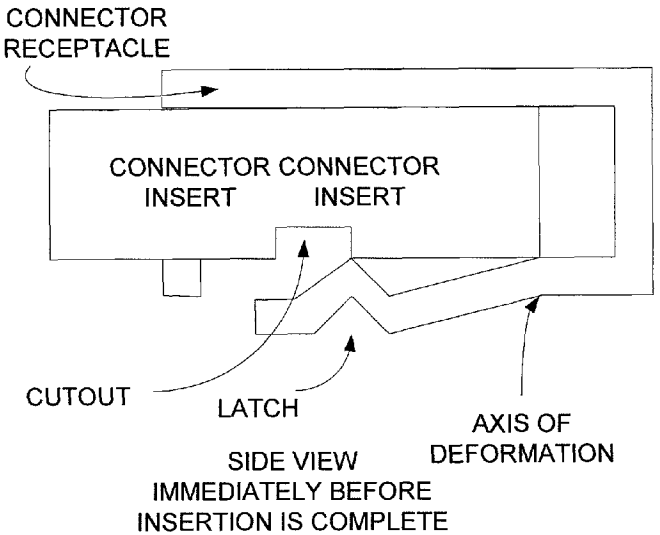
FIG. 5 illustrates the deformation of a latch as a connector insert is inserted into a connector receptacle according to an embodiment of the present invention.
Figure 5:
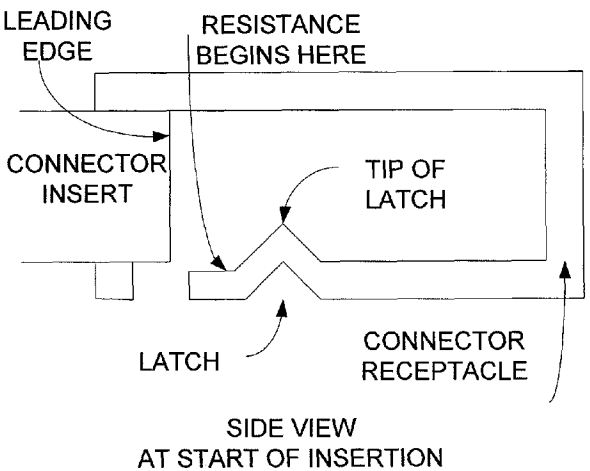
Figure 5:
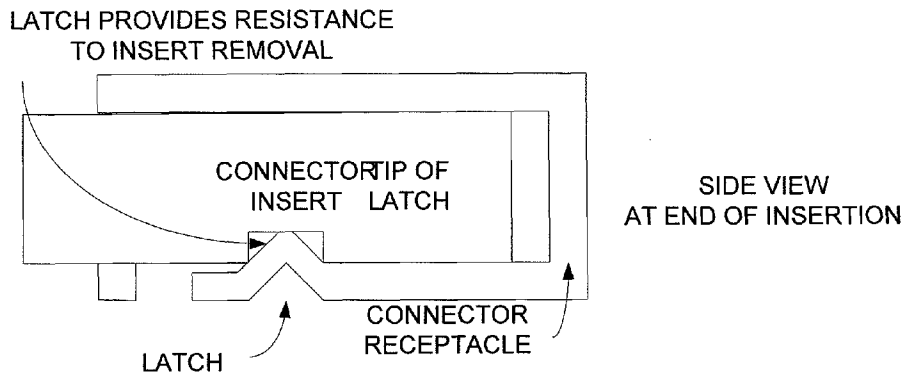

FIG. 5 illustrates the deformation of a latch as a connector insert is inserted into a connector receptacle according to an embodiment of the present invention. As can be seen in the side view of the connector receptacle before insertion, in this example, the latch blocks the connector insert as it is fitted into the connector receptacle, though in other embodiments is does not perform this function. The latch deforms out of the way, again roughly along the axis of deformation shown, once the connector insert is inserted into the connector receptacle.

Again, this latch provides resistance once the connector insert reaches the leading edge of the latch, and stops providing resistance, or provides a reduced resistance once the connector insert leading edge passes the tip of latch.

Once the cutout portion of the connector insert reaches the latch tip, the latch tip enters the cutout portion and the tension on the latch tip releases. The latch tip then provides resistance to a force acting in the direction of removal for the connector insert.

It should be noted that while the latch has a particular shape in these examples, latches may have other shapes in other embodiment of the present invention. For example, rather than being rounded, a latch may come to a point. Alternately, it may have a more rectangular or squared edge.

Figure 6:
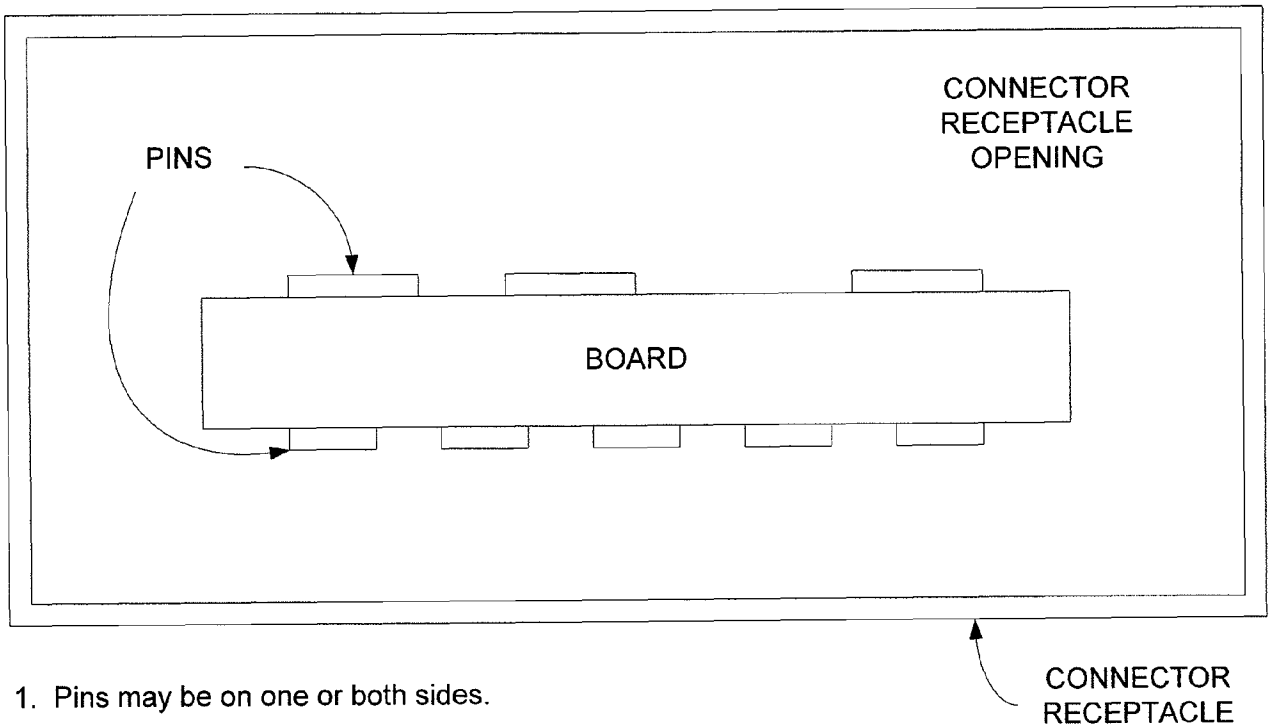
FIG. 6 illustrates a board located in a connector receptacle according to an embodiment of the present invention.

FIG. 6 illustrates a board located in a connector receptacle according to an embodiment of the present invention. The board has a number of pins, which may alternately be implemented as pads, on one or both sides. Again, the board may be plastic, a printed circuit (PC)-type board, or other type of board. The pins may be formed using metal pins, or by using surface mount technology or other appropriate method. The pins on each side may have the same or different sizes and spacing to adjacent pins as compared other pins on that side. Also, in embodiments where pins are both sides, the pins on one side may have the same or different sizes and space things as compared to pins on the other side.

Figure 7:
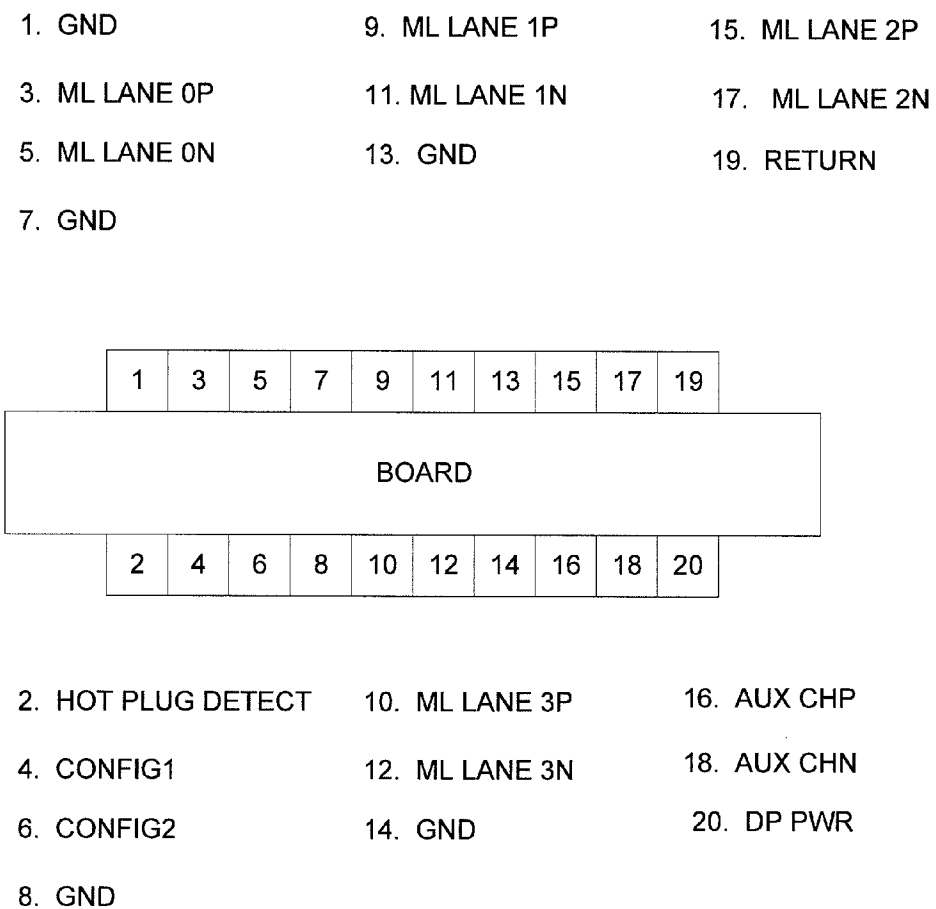
FIG. 7 illustrates a specific pinout employed by a connector receptacle according to an embodiment of the present invention.

FIG. 7 illustrates a specific pinout employed by a connector receptacle according to an embodiment of the present invention. In this example, pins for three data lanes are located on the top of the board, while the pins for a fourth lane are located on the bottom of the board. Each pair of data pins are isolated by a ground pin, that is, each pair of data pins has a ground pin on each side. This arrangement allows sufficient signal integrity to be provided in a highly-desirable form factor.

When a connector insert is inserted into a connector receptacle, it is desirable that the ground connection be made first, before signal and other connections are made. This protects the circuitry connected to the connector receptacle as well as the connector insert. Accordingly, in various embodiments of the present invention, the ground pins in the connector receptacle are longer than the other pins, such as the signal pins. This ensures that the ground connection is the first connection made when a connector insert is inserted into a connector receptacle. Alternately, the ground pins of the connector insert may be longer than the signal pins. In still other embodiments, ground pins on both sides of the connector are longer than their respective signal pins.

This specific embodiment of the present invention provides a DisplayPort interface. In the future, other types of interfaces will be developed, and connector receptacles and connector inserts according to embodiments of the present invention may be used for those as well.

In a specific embodiment of the present invention, the pins each have approximately an 0.6 mm spacing, where the pins are approximately 0.4 mm wide and have a 0.2 mm separation. In various embodiments of the present invention, these dimensions may vary. For example, the spacing may vary between 0.5 and 0.7 mm, while the width varies between 0.3 and 0.5 mm and the separation varies from 0.1 to 0.3 mm. These dimensions are large enough for manufacturability, while providing the desired reduced form factor. In other embodiments of the present invention, other dimensions may be used. For example, the pins may be 0.2 mm wide, while they have a separation of 0.4 mm. Other dimensions for spacing, width, and separation may be used consistent with embodiments of the present invention.

Figure 8:
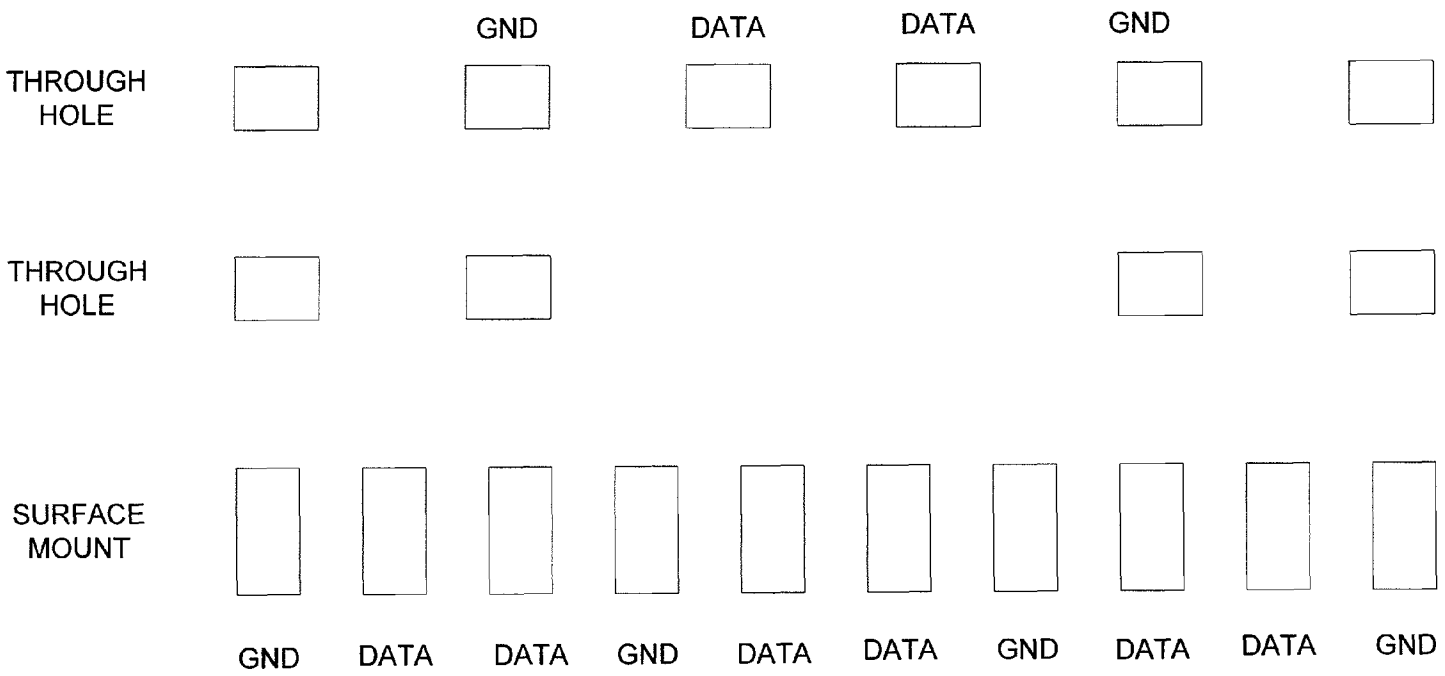
FIG. 8 illustrates an arrangement of pins on a portion of a connector that attaches to the internal circuitry of an electronic device according to embodiment of the present invention.

FIG. 8 illustrates an arrangement of pins on a portion of a connector that attaches to the internal circuitry of an electronic device according to embodiment of the present invention. In this example, three rows of pins are used, two of which are through-hole pins and one of which includes surface mount pins. Again, the through holes provide mechanical stability, and this arrangement allows inspection and rework to be performed when necessary during assembly since there are no hidden or inaccessible surface-mount pins. The pins may connect to a printed circuit board, flex connector, or other appropriate substrate.

In this example, three of the four data lanes come out of the connector on surface mount pins. As on the connector receptacle board, each pair of data pins are surrounded by ground pins. The fourth lane comes out of the connector on the top row of through-hole pins. This separation from the other data pins enhances signal integrity. This fourth lane also has ground pins on either side. Wire lengths can be minimized and route paths can be matched for each signal in a signal pair to improve signal integrity.

In other embodiments of the present invention, the connector receptacle may need to connect to the other side of a printed circuit or other type of board as compared to what is shown in this example. In such a situation, the connector receptacle face can be inverted and the same configuration shown here can be used. Alternately, the connector receptacle face can be maintained and the pin configuration shown here appropriately modified.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A connector receptacle comprising:

a key formed on a frame of the connector receptacle, the key recessed from a front of the connector receptacle;

a latch formed on a bottom of the frame of the connector receptacle;

a plurality of fingers; and a board having a first plurality of contacts on a top side and a second plurality of contacts on a bottom side, wherein the first plurality of contacts are surface mount contacts and the second plurality of contacts are through-hole contacts, wherein the bottom of the frame has chamfered corners.

2. The connector receptacle of claim 1 wherein the board is arranged to insert into an opening in the connector insert, and the board is formed of plastic.

3. The connector receptacle of claim 2 wherein the plastic is substantially bromine and chlorine free.

4. The connector receptacle of claim 2 wherein the connector receptacle provides contacts for a DisplayPort interface.

5. The connector receptacle of claim 4 wherein the connector receptacle is located on a PCIE board.

6. The connector receptacle of claim 5 wherein the connector receptacle is located on a laptop computer.

7. The connector receptacle of claim 4 wherein the opening forms a smaller area than a standard DisplayPort connector receptacle.

8. A connector comprising a connector receptacle and a connector insert, the connector comprising:

the connector receptacle comprising:

a first key formed on a first side of a frame of the connector receptacle and a second key formed on a second side of the frame, the first key and the second key recessed from a front of the connector receptacle a certain distance that the connector insert is to be inserted into the connector receptacle;

a latch formed on the frame of the connector receptacle, the latch formed to provide resistance as the connector insert is initially inserted in the connector receptacle, and to enter a cutout portion of the connector insert and to release the resistance once the connector insert has been inserted into the connector receptacle the certain distance;

a plurality of fingers to provide mechanical support and a electrical connection between the frame of the connector receptacle and a frame of the connector insert; and a bottom of the frame having multiple chamfered corners such that improper insertion of the connector insert is prevented; and the connector insert comprising:

the cutout portion to receive the latch on the connector receptacle when the connector insert is inserted into the connector receptacle a certain distance; and a frame having a bottom having multiple chamfered corners such that improper insertion into the connector receptacle is prevented.

9. The connector of claim 8 further comprising an opening in the connector insert to receive a board formed in an opening in the connector receptacle, each opening comprising a first plurality of contacts on a first side of the opening and a second plurality of contacts on a second side of the opening.

10. The connector of claim 8 wherein the connector provides signal contacts for a DisplayPort interface.

11. The connector of claim 10 wherein the connector receptacle is located on a PCIE board.

12. The connector of claim 11 wherein the connector receptacle is located on a laptop computer.

13. The connector of claim 10 wherein the connector has a smaller form factor than a standard DisplayPort connector.

14. The connector of claim 8 further comprising a board having a first plurality of contacts on a top side and a second plurality of contacts on a bottom side, wherein the first plurality of contacts are surface mount contacts and the second plurality of contacts are through-hole contacts.

15. A connector receptacle comprising:

a first key formed on a first side of a frame of the connector receptacle and a second key formed on a second side of the frame, the first key and the second key recessed from a front of the connector receptacle;

a latch formed on a bottom of the frame of the connector receptacle;

a first finger on the first side of the frame between the first key and the front of the connector receptacle, a second finger on the second side of the frame between the second key and the front of the connector receptacle, and a third finger and a fourth finger on a top of the frame of the connector receptacle; and a board having a first plurality of contacts on a top side and a second plurality of contacts on a bottom side, wherein the first plurality of contacts are surface mount contacts and the second plurality of contacts are through-hole contacts, wherein the bottom of the frame has chamfered corners.

16. The connector receptacle of claim 15 wherein the connector provides signal contacts for a DisplayPort interface.

17. The connector receptacle of claim 15 wherein the connector receptacle is located on a PCIE board.

18. The connector receptacle of claim 15 wherein the connector receptacle is located on a laptop computer.

19. The connector receptacle of claim 15 wherein the connector has a smaller form factor than a standard DisplayPort connector.

* * * * *